United States Patent [19]

Hall et al.

[11] Patent Number: 4,538,311

[45] Date of Patent: Sep. 3, 1985

[54] SELF-SEALING PUNCTURABLE ARTICLE

[75] Inventors: Charles P. Hall, Santa Rosa; Joseph Philipson, Pasadena; John B. Johenning, Los Angeles, all of Calif.

[73] Assignee: Monterey Manufacturing Co., Carson, Calif.

[21] Appl. No.: 517,222

[22] Filed: Jul. 25, 1983

Related U.S. Application Data

[63] Continuation-in-part of Ser. No. 474,545, Mar. 11, 1983, abandoned.

[51] Int. Cl.[3] ..... A45F 1/00; A47C 27/08; E04C 5/02; E04C 7/00

[52] U.S. Cl. ..... 5/451; 5/441; 5/449; 52/309.1; 135/115; 428/912

[58] Field of Search ..... 5/449, 450, 451, 455, 5/441; 428/912; 135/87, 96, 104, 115; 441/35, 40; 114/345; 52/408, 309.1

[56] References Cited

U.S. PATENT DOCUMENTS

| | | | |
|---|---|---|---|
| Re. 29,890 | 1/1979 | Gomberg . | |
| 982,049 | 1/1911 | Gayner | 428/912 X |
| 1,888,909 | 11/1932 | Crosthwait | 135/115 X |
| 2,342,580 | 2/1944 | Hartz | 428/912 X |
| 3,421,163 | 1/1969 | Stoughton | 5/449 |
| 3,574,873 | 4/1971 | Weinstein | 5/451 X |
| 3,577,306 | 5/1971 | Baker et al. | 428/912 X |
| 3,598,133 | 8/1971 | Abert et al. | 135/115 X |
| 3,664,904 | 5/1972 | Cook | 428/912 |
| 3,698,587 | 10/1972 | Baker et al. | 428/912 X |
| 3,736,974 | 6/1973 | Carson, Jr. . | |
| 3,742,531 | 7/1973 | Allsbury . | |
| 3,761,974 | 10/1973 | Kuss . | |
| 3,862,527 | 1/1975 | Peterson | 52/408 X |
| 3,952,787 | 4/1976 | Okado et al. | 428/912 X |
| 3,981,342 | 9/1976 | Farber et al. | 428/912 X |
| 4,057,090 | 11/1977 | Hoshikawa et al. | 428/912 X |
| 4,145,780 | 3/1979 | Fogel . | |
| 4,149,286 | 4/1979 | Fogel . | |
| 4,171,237 | 10/1979 | Bohm et al. | 428/912 X |
| 4,192,031 | 3/1980 | Fogel . | |
| 4,235,058 | 11/1980 | Patry | 52/408 |
| 4,259,817 | 4/1981 | Elliott | 52/408 X |
| 4,382,305 | 5/1983 | Hall et al. | 5/451 |

FOREIGN PATENT DOCUMENTS

| | | | |
|---|---|---|---|
| WO79/00058-12 | 12/1979 | PCT Int'l Appl. | 52/408 |
| 0613371 | 9/1979 | Switzerland | 135/115 |

OTHER PUBLICATIONS

Vinyl Products Advertisement, two pages, 1979.

*Primary Examiner*—George A. Suchfield
*Attorney, Agent, or Firm*—Sheldon & Mak

[57] ABSTRACT

Flexible self-sealing sheeting comprises a flexible, puncturable sheet of cloth or polymeric material, a layer of a self-adhering, water-resistant polyurethane sealing material, and an anti-tack barrier. The sheeting can be used to form a waterbed mattress, swimming pool, tent, inflatable boat, tarp, roof, and other self-sealing articles.

16 Claims, 8 Drawing Figures

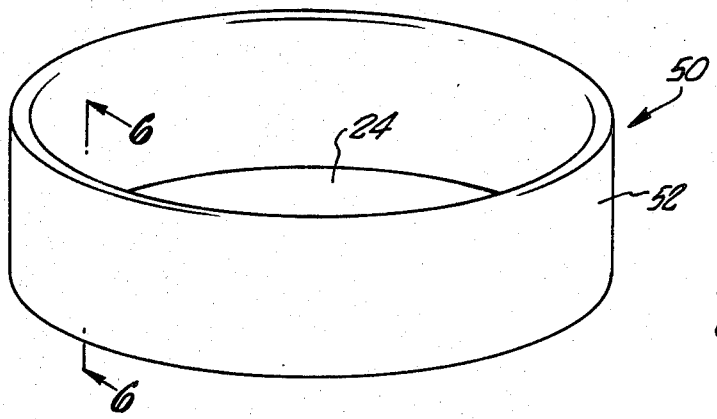
FIG. 5.
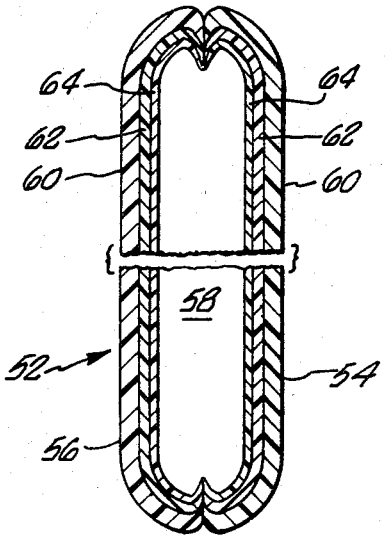
FIG. 6.
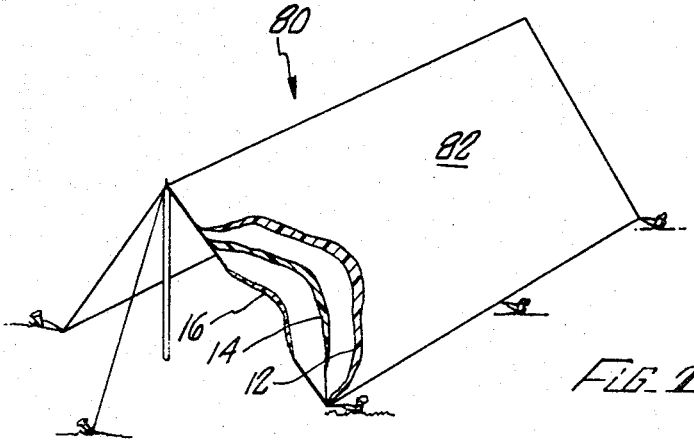
FIG. 7.
FIG. 8.
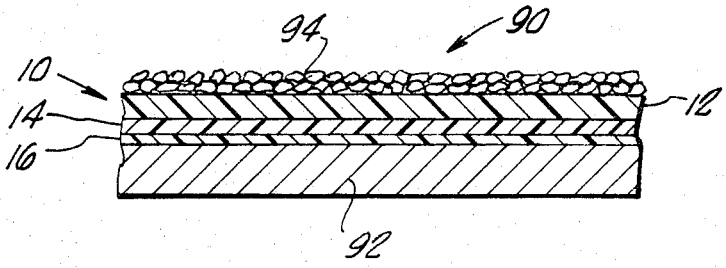

SELF-SEALING PUNCTURABLE ARTICLE

CROSS-REFERENCES

This application is a continuation-in-part of application Ser. No. 474,545 filed Mar. 11, 1983 now abandoned, which is incorporated herein by this reference. This application is related to application Ser. No. 134,628 filed Mar. 27, 1980, now U.S. Patent No. 4,382,305 and U.S. patent application Ser. No. 421,369 filed on Sept. 22, 1982, now U.S. Pat. No. 4,501,035, both of which are incorporated herein by this reference. Application Ser. No. 421,369 is a continuation of application Ser. No. 134,628.

BACKGROUND

This invention relates to puncturable articles formed of cloth or polymeric materials.

Mankind has always been plagued with articles that leak when they are not supposed to leak. Swimming pools, tents, roofs, rafts, inflatable toys, and waterbed mattresses all share a common feature, namely they are all susceptible to developing leaks, often with disastrous consequences.

These and other useful articles are formed from a thin, puncturable sheet of cloth such as canvas or polymeric materials such as polyvinyl chloride or polyethylene. It is desirable to use these materials. For example, for waterbed mattresses polyvinyl chloride is an excellent material to use in that it is durable, flexible, and can easily be bonded to itself by adhesives and heat for forming sheets into the configuration of a waterbed.

Unfortunately, an owner of a waterbed mattress, forgetting that he does not have a conventional mattress, can stick a pin into the mattress, thereby causing a leak. Also, cats and other domestic animals are known to rip waterbed mattresses, rafts, and other items.

Leaks from these articles can be, at a minimum, inconvenient, and in some cases disastrous. A leaking swimming pool or waterbed mattress can create property damage. A leaking raft could result in loss of human life.

In view of these problems, there is a need for non-leaking, self-sealing articles formed from flexible sheets of cloth and polymeric material.

SUMMARY

The present invention is directed to a self-sealing article having these features. The article is designed to hold fluid such as water or air inside of it, i.e. it functions as a container or it is designed to keep fluid out of a space, i.e. such as a tent.

The article comprises a flexible, puncturable sheet formed of cloth or polymeric material. The article is provided with an internal layer or film of a sealing material for sealing punctures in the sheet. In the absence of the sealing material, the article, when punctured or torn, develops a fluid leak where a fluid such as water or pressurized air leaks into or out of the article.

The sealing material is a self-adhering, water-resistant material that has a sufficiently high viscosity at 100° F. that it does not flow through a puncture in the sheet. The sealing material is sufficiently tacky that it adheres to the sheet and is pulled into a puncture in the sheet by the object that causes the puncture and seals the puncture against fluid leakage therethrough. A preferred sealing material is a tacky, non-foaming polyurethane, preferably a polyether polyurethane such as a polyurethane comprising a reaction product of a polyoxypropylene glycol and toluene diisocyanate.

The sheet is generally less than 100 mils thick. The sealing material preferably is provided in a layer or film of less than 100 mils of thickness, preferably less than 50 mils thick, and more preferably in a thickness of from 25 to 40 mils. The thicker the layer, the larger the hole that can be sealed.

A barrier is provided on the surface of the sealing material not in contact with the sheet to keep the layer of sealing material from sticking to itself. Thus, sealing material is sandwiched between the barrier and the flexible sheet. The barrier preferably is a polyethylene film.

One technique for forming articles of the present invention is to form sheeting comprising the sheet of flexible material, the self-sealing material, and the barrier. This sheeting can then be fabricated into the desired shape.

Alternatively, a sheet of canvas or polymeric material can be fabricated into the shape of the article, and then the sealing material and barrier can be applied.

By provision of the sealing material, minor punctures and rips that occur in the article are automatically sealed. This prolongs the life of the article, can be an important safety feature for articles such as life rafts, and can prevent damage that can occur from leaks such as damage from water in a waterbed mattress spilling onto surrounding floor surfaces.

DRAWINGS

These and other features, aspects, and advantages of the present invention will become better understood with reference to the following description, appended claims, and accompanying drawings where:

FIG. 5 is a perspective view of a swimming pool according to the present invention;

FIG. 6 is a view vertical section of the swimming pool of FIG. 5 taken along 6—6 of FIG. 5;

FIG. 7 is a perspective view, partly in section, of a tent according to the present invention; and FIG. 8 is a sectional view of a roof according to the present invention.

DESCRIPTION

Figure 1:
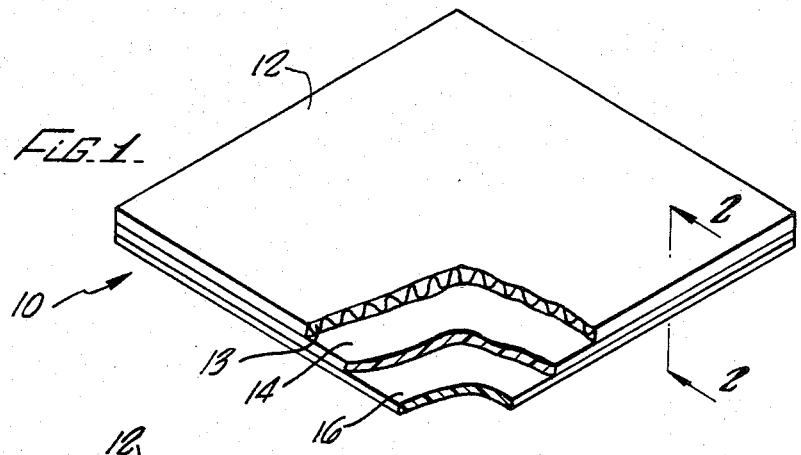
FIG. 1 is a perspective view, partly in section, of sheeting according to the present invention.
Figure 2:
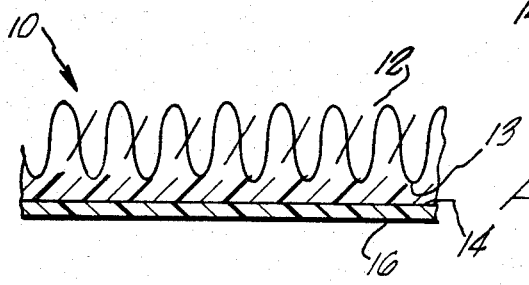
FIG. 2 is a sectional view of another version of sheeting according to the present invention taken along a line corresponding to line 2—2 of FIG. 1.

The present invention is directed to a self-sealing article. With reference to FIGS. 1 and 2, the self-sealing article can be a piece of sheeting 10 comprised of three parts. The sheeting includes a flexible, puncturable sheet 12 formed of cloth (as shown in FIG. 2) or polymeric material (as shown in FIG. 1). Adhered to a surface 13 the sheet 12 is a layer 14 of a self-adhering, water-resistant sealing material for sealing punctures in the sheet 12. The sealing material 14 covers at least a portion of one of the surfaces of the sheet 12, and preferably covers the entire surface 13 of the sheet 12. A barrier 16 of anti-tack material adheres to the layer 14 of sealing material for preventing the sealing material from sticking to itself when the sheeting 10 is folded or shipped.

The sheet 12 is formed of a broad stretch or surface of cloth or polymeric material that is flexible, i.e. the sheet 12 can be repeatably flexed and can be folded upon itself.

The sheeting 10 and sheet 12 are both flexible and also pliable, i.e. they are supple enough to bend freely and repeatedly without breaking.

Suitable materials for the sheet 12 are materials made by weaving, felting, or knitting natural and synthetic fibers and filaments, as well as sheets made from polymer such as neoprene, nylon, polyvinyl chloride, polyethylene, urethanes, and the like.

The sheet 12 is generally thin, in the order of less than about 100 mils thick, and preferably less then 50 mils thick.

The sealing material is formed of a self-adhering, water-resistant material, and preferably a polymeric material. By the term "self-adhering" there is meant a material that when torn into two portions and recontacted to itself, the tensile strength of the recontacted portions at the interface is about the same as the tensile stength of the undisturbed material.

The sealing material serves to automatically seal punctures, rips, cuts and the like in the sheet 12 resulting from domestic animals, pins, nails, knives and razors. In order for the sealing material to function properly, it requires specific rheological properties. It needs to have a sufficiently low viscosity at room temperature, on the order of about 60° F., that it can flow into a puncture hole. It needs to have a sufficiently high viscosity, even at the maximum elevated operating temperatures of the sheeting, that it does not flow all the way through a puncture in the envelope, i.e. it does not leak out through the sheet.

To determine if a candidate sealing material meets these requirements, a simple test can be conducted. The sealing material is placed in a layer of about 5 to 10 mils thick between two polyethylene bags, each bag being about 4 mils in thickness. The internal bag is filled with about a quart of water at a selected temperature. Both bags are then punctured with a nail to produce a hole of about 1/16 inch in diameter. A satisfactory sealing material is one that seals the hole and prevents water from leaking out at about 60° F. to 100° F., but does not flow out of the hole at 100° F.

Another requirement for the sealing material is that it stays in position as a film or layer adjacent the sheet 12, even on vertical surfaces. In addition, the sealing material should not adversely affect the sheet 12, or any other materials with which the sealing material comes in contact. Preferably the sealing material contains nothing that can migrate through the sheet 12 and is deleterious to the health of the user of an article formed from the sheeting 10.

Preferably the sealing material is provided in a film or layer 14 less than about 50 mils (0.050 inch), because thicker films decrease the flexibility and increase the cost of the sheeting. If the thickness is much less than about 5 mils, holes larger than 10 mils in diameter may not be automatically sealed. Thus, preferably the sealing material is provided in a layer 14 of at least about 5 mils, and preferably from about 25 to about 40 mils in thickness, to seal holes 50 mils in diameter.

The preferred material for the sealing material is a tacky polyurethane, either a poly(ester) polyurethane or a poly(ether)polyurethane of sufficiently high viscosity to satisfy these rheological requirement and sufficiently tacky to adhere to the surface 13 of the sheet 12. Preferably poly(ether)-polyurethanes are used because of their hydrolytic stability for applications in which the sheeting 10 contacts water.

Preferably the polyurethane is non-foamed because a foamed material would result in bulky sheeting. However, a foamed material can be used to obtain the advantage of heat insulation.

Preferably the polyurethane is the reaction product of a polyisocyanate reactant and a polyether reactant. The aromatic diisocyanates are preferred. Especially preferred are the toluene diisocyanate isomers. The commercially available blends of the 2,4- and 2,6- isomers are effective; the 80:20 and 65:35 blends are most readily available.

The polyether reactants are hydroxyl group terminated polyfunctional polyethers of the type commonly used in poly(ether)urethane formulations. Preferred are the polyoxyalkylene polyols having 2–4 hydroxyl groups where the alkylene has 2–6 carbon atoms. The condensation can involve an alkylene oxide, such as ethylene oxide, propylene oxide, or butylene oxide, with a glycol. Higher polyethers can be obtained by reaction with a triol or high polyols, such as glycerine, trimethylolpropane, and pentaerythritol.

Polyols of the above types are available commercially, for example: Voranols (trademark) from Dow Chemical Company; Poly-G (trademark) from Olin Chemicals Division; Pluracols (trademark) from BASF Wyandotte Corporation, and Niax (trademark) from Union Carbide.

A preferred polyether reactant comprises polyoxypropylene glycol, comprising diols and triols, and preferably at least about 10 mole percent triols.

The isocyanate and the diol polyether can be combined to form prepolymers, one prepolymer where substantially all of the terminal groups are isocyanate groups and a second prepolymer where substantially all of the terminal groups are hydroxy groups.

The poly(ether)urethane elastomer, which is essentially free of voids, can be formed by combining the two prepolymer preparations in the presence of a catalyst. Alternatively, and preferably, the isocycanate terminated prepolymer can be combined with the unreacted polyols. Also the hydroxy terminated prepolymer can be combined with unreacted isocyanate. For room temperature curing, preferably a tin catalyst is used.

An excess of polyol is preferred so that the mole ratio of hydroxy groups to isocyanate groups is about 1.01 to about 1.05.

EXAMPLE 1

A preferred poly(ether)urethane elastomer was prepared from toluene diisocyanate and polyoxypropolyene glycol. The final product had an elongation of 1500%, a tensile strength of 100 psi, adhered both to polyvinylchloride sheet and polyethylene sheet, and a flow temperature greater than 275° F. It had a shore A hardness of zero and a tear strength Die C of 15±5 pli. The product had a gel time of about 15 minutes for 200 grams mixed at 72° F. The polyol component, which contains the catalyst, had a viscosity at 72° F. of 770 cp and a specific gravity at 72° F. of 1.027. The prepolymer component, which is isocyanate terminated, had a viscosity at 72° F. of about 750 cp and a specific gravity at 72° F. of 1.034. They were combined in 1:1 proportions by volume.

Such a material is available from Synair Corporation of Chattanooga, Tenn., Formula 4343.

It has been found that a 7 mil layer of this material can seal a pin hole 25 mils in diameter.

EXAMPLE 2

Another satisfactory material is formed from (a) 1 mole of Union Carbide Niax PPG 2025 diol which has an equivalent weight of 1000, (b) 1 mole of Union Carbide Niax PPG 168 triol which has an equivalent weight of 1000, and (c) 1.98 moles of toluene diisocyanate of equivalent weight of 87. Dibutyltin dilaurate was used as a catalyst at a level of 0.1% by weight of the reactants. The product polymerized at room temperature.

If desired, the diol, diisocyanate and catalyst can be heated together in a flask at 140° F. to form an isocyanate terminated prepolymer, which can then be reacted with the triol at room temperature.

A barrier 16 that conforms generally to the shape of the envelope 12 is provided. The barrier 16 of anti-tack material adheres to the sealing material and prevents the sealing material from sticking to itself. When sheeting 10 and the other articles according to the present invention are shipped, they can be folded. Without the barrier 16, the tacky sealing material would stick to itself during shipping.

Preferably the barrier 16 is a thin sheet of polymeric material that maintains its flexibility and tear resistance over a long life and in contact with water. The preferred material for the barrier 16 is polyethylene. A satisfactory barrier has been made from polyethylene that is only ½–1 mil thick.

The barrier can also be an anti-tack agent such as talc or other material that renders the internal surface of the layer of sealing material non-tacky.

The barrier can also be a non-tacky film that forms in situ on the surface of the sealing material. This can be accomplished with polyurethane sealants by producing a material with excess isocyanate groups, and exposing the material to moist air. A non-tacky skin forms on the surface of the sealing material with this technique. The sealing material preferably is at least ¼ inch thick to be sure that a portion of the layer of sealing material remains tacky. Thus, this technique may not be acceptable for applications where weight is an important consideration.

The relative thickness of the layers is not necessarily shown to scale in any of the Figures.

The sheeting 10 can be used for forming many articles. An article can be formed into the desire shape with the sheeting 10 by use of adhesives, stitching, heat welding, ultrasonic welding, and other techniques that would be used for the sheet 12 by itself.

Alternatively, articles according to the present invention can be formed by starting with the sheet 12 of cloth or polymeric material and forming that into a desired shape. Then, the sealing material and barrier can be applied to the formed sheet.

A variety of articles can be made self-sealing according to the present invention. Such articles generally fall into two categories. The first category is containers that hold fluids such as air or water. Exemplary of such containers are waterbed mattresses, inflatible toys, life preservers, boats, rafts, ballons, and the like.

A second category is articles designed to keep a fluid such as water or air out of a space. Exemplary of such articles are tents, tarps, and roofs.

Figure 3:
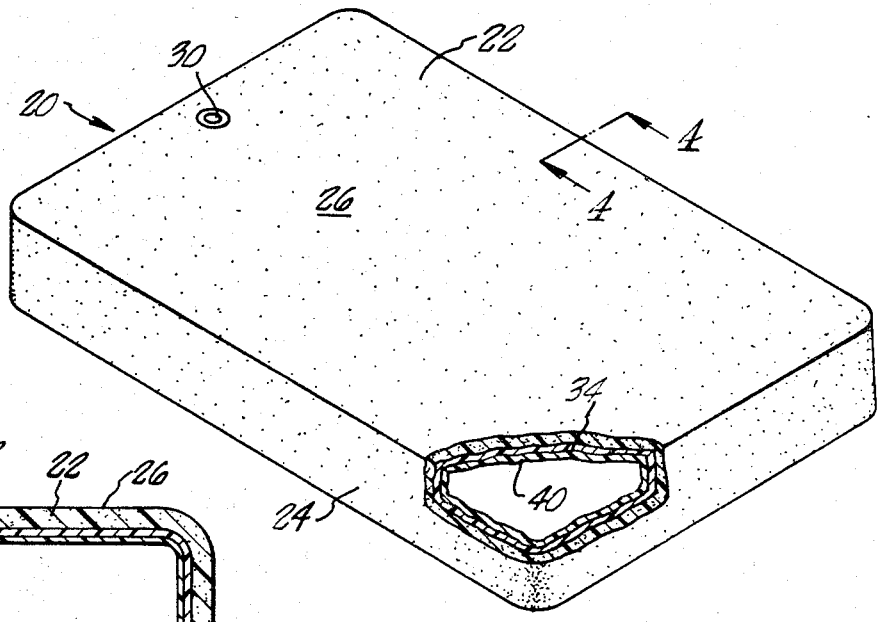
FIG. 3 is a perspective view, partly in section, of a waterbed mattress according to the present invention.
Figure 4:
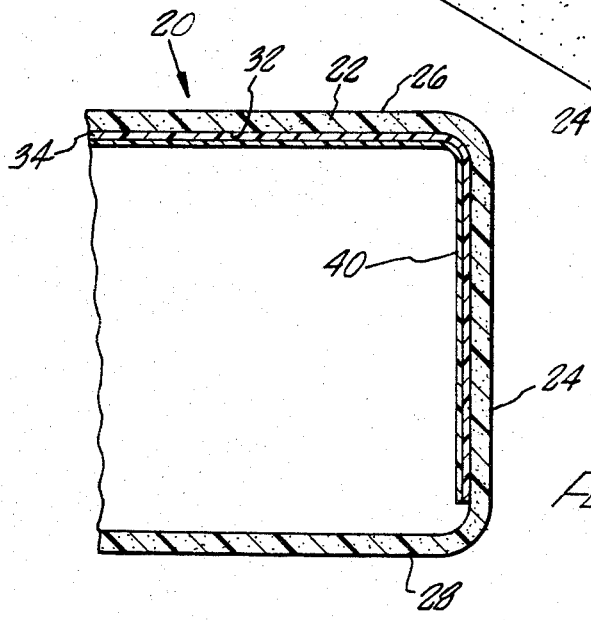
FIG. 4 is a sectional view of another version of a waterbed mattress according to the present invention taken along a line corresponding to line 4—4 of FIG. 3.

With reference to FIGS. 3 and 4, there is shown a self-sealing waterbed mattress 20 according to the present invention. Like a conventional waterbed mattress, the waterbed mattress 20 comprises an exterior, generally rectangular enclosure or envelope 22 that defines the side 24, top 26 and bottom 28 walls or surfaces of the waterbed mattress 20. The top wall 26 of the waterbed mattress 20 serves as a sleeping surface and is adapted for receiving persons in sitting and reclining positions. The mattress 20 is provided with a fill and drain valve 30.

The envelope 22 is of conventional construction and is generally formed of flexible, plasticized polyvinylchloride. Its thickness is in the range of from about 10 to about 30 mils, and preferably about 20 mils. The envelope can be formed according to conventional techniques using adhesives and heat welding, and preferably by heat welding the seams. It can be formed by bonding two planar sheets together along their periphery or by bonding upstanding sheets between the edges of the top and bottom walls to form a contoured or fitting structure.

On the internal surface 32 of the envelope 22 is a thin film or layer 34 of a sealing material that serves to seal any leaks that form in the envelope. For a king size waterbed, less than 10 pounds of sealing material are required, and generally on the order of from about 5 to about 7 pounds are required.

A two component polyurethane sealing material is particularly adapted for manufacture of a waterbed mattress where the mattress is formed from two sheets, a top sheet and a bottom sheet. Before the polyurethane cures, it has a relatively low viscosity. Therefore it can easily be sprayed or brushed onto the internal surface of the top sheet of the envelope. Then a barrier layer 40 is placed on the layer of sealing material after it has at least partially cured. Because the sealing material is tacky it adheres to the top sheet of the envelope and the barrier sheet 40 adheres to the sealing material. Then the bottom and top sheets are secured together in the conventional fashion such as heat welding to form the mattress.

As shown in FIG. 4, there is no sealing material along the bottom wall 28 of the mattress. However, it is unusual for the leak to form in the bottom wall of the mattress since it rests on the floor of a pedestal. Thus the sealing material is present where needed, namely along the side walls and top wall of the mattress.

Of course, sealing material can be on all of the walls of the mattress by coating all of the sheets used to form the mattress with sealing material.

In one version of the invention, the barrier can be a relatively thick layer of polyethylene or polyurethane foam, i.e., in the order of about ⅛" thick. An advantage of using foam as the barrier is that the foam provides heat insulation to the mattress, reducing the amount of energy required for maintaining the water in the mattress at the desired temperature.

FIGS. 5 and 6 show an inflatible swimming pool 50 which is exemplary of inflatible toys according to the present invention. The swimming pool 50 comprises an inflatible, peripheral side 52 and a bottom 54 that sits on the ground. The side 52 and bottom 54 form an enclosure that is filled with water.

With reference to FIG. 6, the side 52 comprises an inner wall 54 and an outer wall 56 sealed together to form an air chamber 58. Each wall 54 and 56 comprises an outer sheet 60 of polymeric material such a polyvinyl chloride, a middle layer 62 of self sealing material, and an inner barrier 64 of anti-tack material.

Punctures in the side walls 54 and 56 are sealed by the self-sealing material, and the two layers of sealing material do not stick together because of the barriers 64.

FIG. 7 shows a tent 80, the side walls 82 of which are formed from the sheeting 10 of FIG. 2, where the sheet 12 is made from canvas. The side walls include the layer 14 of self-sealing material and the barrier 16. Thus, even if the tent is punctured, a camper will not wake up wet.

With reference to FIG. 8, a roof 90 has an underlying wood substrate 92. The wood is covered with the sheeting 10 of FIG. 1 and 2 where the sheet 12 is formed from polyvinyl chloride containing anti-oxidants. The barrier 16 is in contact with the wood substrate 92. Piled on top of the sheeting 10 in contact with the top surface of the sheet 12 is gravel 94 or other rock material. If desired, layers of tar paper and asphalt can be used.

Because of the presence of the sealing material, punctures in the plastic layer 12 often do not result in leaks.

Although the present invention has been described in considerable detail with reference to certain preferred versions thereof, other versions are possible. Therefore the spirit and scope of the appended claims should not necessarily be limited to the description of the preferred versions contained herein.

What is claimed is:

1. A waterbed mattress comprising a flexible top wall, a flexible side wall, and a flexible bottom wall, each wall having an inside surface for holding water in the mattress, at least one of the walls comprising:

(a) an outer, flexible puncturable sheet formed of a polymeric material sheet, the sheet being less than 100 mils thick;

(b) a middle layer of a self-sealing, water-resistant sealing material for sealing punctures in the sheet, the middle layer being less than 100 mils thick, the sealing material being sufficiently tacky that it adheres to the sheet and can be pulled into a puncture in the sheet by the object that causes the puncture, the sealing material having a sufficiently high viscosity at 100° F. that it does not flow through a puncture in the sheet, the sealing material comprising a polyurethane elastomer; and (c) an inner anti-tack barrier adhered to the layer of the sealing material for preventing the layer of sealing material from sticking to itself.

2. The matress of claim 1 in which the elastomer is a polyether polyurethane elastomer.

3. The mattress of claim 2 in which the layer of sealing material is from about 5 to about 10 mils thick.

4. The mattress of claim 2 in which the polyurethane comprises the reaction product of (i) polyoxypropylene glycol or polyoxybutylene glycol and (ii) an aromatic diisocyanate.

5. The mattress of claim 1 in which the layer of sealing material is less than 50 mils thick.

6. The mattress of claim 1 in which the outer sheet and the middle layer of the wall are in direct contact with each other.

7. A tent comprising side walls, each having an exterior surface and an interior surface, at least a portion of one of the side walls comprising:

(a) an exterior, puncturable sheet formed of cloth or polymeric material, the sheet being less than 100 mils thick;

(b) a middle layer of self-adhering, water-resistant, sealing material for sealing punctures in the sheet, the layer being less than 100 mils thick, the sealing material covering at least a portion of one of the surfaces of the sheet, the sealing material being sufficiently tacky that it adheres to the sheet and can be pulled into a puncture in the sheet by the object that causes the puncture, the sealing material having a sufficiently high viscosity at 100° F. that it does not flow through a puncture in the sheet, the sealing material comprising a polyurethane elastomer; and (c) an interior antitack barrier on the layer of sealing material for preventing the layer of sealing material frqm sticking to itself.

8. The tent of claim 7 in which the elastomer is a polyether polyurethane elastomer.

9. The tent of claim 7 in which the exterior sheet and the middle layer of the side wall are in direct contact with each other.

10. A roof comprising fragmented rock on top of plastic sheeting, the sheeting comprising:

(a) an upper flexible, puncturable sheet formed of cloth or polymeric material, the sheet being less than 100 mils thick;

(b) a middle layer of a self-adhering, water resistant, sealing material for sealing punctures in the sheet, the layer being less than 100 mils thick, the sealing material covering at least a portion of one of the surfaces of the sheet, the sealing material being sufficiently tacky that it adheres to the sheet and can be pulled into a puncture in the sheet by the object that causes the puncture, the sealing material having a sufficiently high viscosity at 100° F. that it does not flow through a puncture in the sheet, the sealing material comprising a polyurethane elastomer; and (c) a lower antitack barrier on the layer of sealing material for preventing the layer of sealing material from sticking to itself.

11. The roof of claim 10 in which the elastomer is a polyether polyurethane elastomer.

12. The roof of claim 10 in which the upper sheet and middle layer of the plastic sheeting are in direct contact with each other.

13. A waterbed mattress comprising a flexible top wall, a flexible side wall, and a flexible bottom wall, each wall having an inside surface for holding water in the mattress, at least one of the walls comprising:

(a) an outer, flexible puncturable sheet formed of polyvinyl chloride, the outer sheet being less than 100 mils thick;

(b) a middle layer of a self-sealing, water-resistant sealing material for sealing punctures in the sheet, the middle layer being less than 50 mils thick, the sealing material being sufficiently tacky that it adheres to the sheet and can be pulled into a puncture in the sheet by the object that causes the puncture, the sealing material having a sufficiently high viscosity at 100° F. that it does not flow through a puncture in the sheet, the sealing material comprising a polyurethane elastomer, the outer sheet and middle layer being in direct contact with each other; and (c) an inner anti-tack barrier adhered to the layer of the sealing material for preventing the layer of sealing material from sticking to itself.

14. The mattress of claim 13 in which the layer of sealing material is a polyether polyurethane elastomer from about 5 to about 20 mils thick.

15. A tent comprising side walls, each having an exterior surface and an interior surface, at least a portion of one of the side walls comprising:

(a) an exterior, puncturable sheet formed of polyvinyl chloride, the sheet being less than 100 mils thick;

(b) a middle layer of self-adhering, water-resistant, sealing material for sealing punctures in the sheet, the layer being less than 50 mils thick, the sealing material covering at least a portion of one of the surfaces of the sheet, the sealing material being sufficiently tacky that it adheres to the sheet and can be pulled into a puncture in the sheet by the object that causes the puncture, the sealing material having a sufficiently high viscosity at 100° F. that it does not flow through a puncture in the sheet, the sealing material comprising a polyurethane elastomer, the exterior sheet and the middle layer being in direct contact with each other; and (c) an interior antitack barrier on the layer of sealing material for preventing the layer of sealing material from sticking to itself.

16. A roof comprising fragmented rock on top of plastic sheeting, the sheeting comprising:

(a) an upper flexible, puncturable sheet formed of polyvinyl chloride, the sheet being less than 100 mils thick;

(b) a middle layer of a self-adhering, water resistance, sealing material for sealing punctures in the sheet, the layer being less than 50 mils thick, the sealing material covering at least a portion of one of the surfaces of the sheet, the sealing material being sufficiently tacky that it adheres to the sheet and can be pulled into a puncture in the sheet by the object that causes the puncture, the sealing material having sufficiently high viscosity at 100° F. that it does not flow through a puncture in the sheet, the sealing material comprising a polyurethane elastomer, the upper sheet and middle layer being in direct contact with each other; and (c) a lower antitack barrier on the layer of sealing material for preventing the layer of sealing material from sticking to itself.

* * * * *